United States Patent [19]

Morgan et al.

[11] 4,211,379

[45] Jul. 8, 1980

[54] PANELBOARD AND MOUNTING FIXTURE COMBINATION

[76] Inventors: Myron B. Morgan, 15200 SW. 78 Ct., Miami, Fla. 33157; Steven F. Sharloe, 18101 NW. 68 Ave., Miami Lakes, Fla. 33015

[21] Appl. No.: 961,881

[22] Filed: Nov. 20, 1978

[51] Int. Cl.[2] ..... A47G 29/02

[52] U.S. Cl. ..... 248/222.2; 52/36; 248/243

[58] Field of Search ..... 248/222.2, 222.3, 221.3, 248/221.4, 222.1, 225.1, 224.4, 225.2, 215, 223.4, 224.1, 224.2, 243; 211/87, 90, 187; 52/36; 108/108

[56] References Cited

U.S. PATENT DOCUMENTS

| | | | |
|---|---|---|---|
| 3,081,718 | 3/1963 | Shoffner | 108/108 UX |
| 3,172,540 | 3/1965 | Berge | 211/90 X |
| 3,196,812 | 7/1965 | Jacques | 108/108 X |
| 3,235,218 | 2/1966 | Graham | 248/220.3 |
| 3,333,555 | 8/1967 | Kapnek | 211/90 X |
| 3,381,636 | 5/1968 | Saiberlich | 211/90 X |
| 3,604,669 | 9/1971 | Asher | 108/108 X |

FOREIGN PATENT DOCUMENTS

| | | | |
|---|---|---|---|
| 164103 | 2/1949 | Austria | 108/108 |
| 81527 | 12/1956 | Denmark | 248/243 |
| 83485 | 4/1954 | Norway | 248/243 |
| 482723 | 4/1938 | United Kingdom | 248/243 |

*Primary Examiner*—J. Franklin Foss
*Attorney, Agent, or Firm*—Jack E. Dominik

[57] ABSTRACT

A mounting fixture of unitary construction is disclosed for use in combination with panel board having regularly spaced lateral grooves with an undercut. The fixture is mounted on the panel board by a manual insertion, involving the positioning of the uppermost free end of the fixture into an associated groove, and thereafter downwardly rotating the fixture until the lower portion thereof engages a similar groove.

4 Claims, 2 Drawing Figures

PANELBOARD AND MOUNTING FIXTURE COMBINATION

BACKGROUND OF THE INVENTION

1. Field Of The Invention

This invention relates generally to mounting fixture devices, and more particularly relates to a mounting fixture which is constructed to mate with panel board having lateral grooves cut therein at regularly spaced intervals.

2. Description of the Prior Art

Fixtures built to serve the function of displaying consumer merchandise generally comprise outwardly extending arm members which are mounted to a base plate, secured to a wall, a pegboard, or other suitable backing. Exemplary of such devices, are the apparatus' disclosed in U.S. Pat. Nos. 2,988,768; 2,926,824; 3,567,036; 2,271,250; 3,310,271; and 3,476,344.

To secure most of the prior art devices to the wall of a retail establishment necessitates inflicting permanent damage upon the walls by nailing or bolting the display fixture to the wall. If the display fixture is relocated, unsightly holes must be filled with suitable compounds.

The construction of most of the prior art devices also involves the use of bolts, nuts, and other mechanical locking devices. Thus, not only are tools needed to assemble the prior art fixtures, but tools are also needed to affix the fixtures to the mounting surface.

SUMMARY OF THE INVENTION

It is therefore an object of the present invention to provide a mounting fixture of unitary construction, which therefore overcomes the need for assembly associated with prior art devices.

It is a further object of the invention to provide a mounting fixture which can be mounted to a panel board without the use of tools.

Yet another object of the invention is to provide a mounting fixture which can be mounted on a panel board without damaging either the fixture or the panel board.

Yet another object of the invention is to provide a mounting fixture which can easily be relocated on the face of the panel board without tools and without leaving unsightly reminders of its previous location.

Another object of the invention is to provide a mounting fixture which can be moved laterally without disengaging it from the panel board.

Still another important object of the invention is to provide a bracket for use in home workshops, home study rooms, general offices, sales offices with product or service displays, laundry rooms, or any location where a bracket can be gainfully employed to hold tools, shelves, or other items.

These objects and others are achieved by the present invention of unitary construction which is characterized by projecting members formed at the uppermost and lowermost ends thereof, which are received within grooves provided in the panel board employed in combination with the invention.

DESCRIPTION OF THE PREFERRED EMBODIMENT

Figure 1:
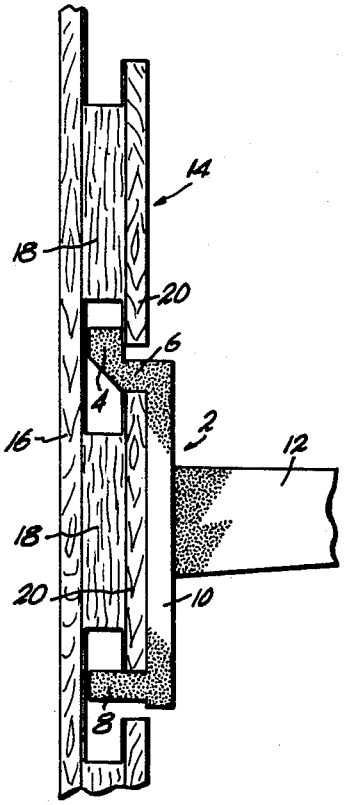
FIG. 1 is a side plan view of the panel board used in combination with the invention. The invention is shown in its installed position.
Figure 2:
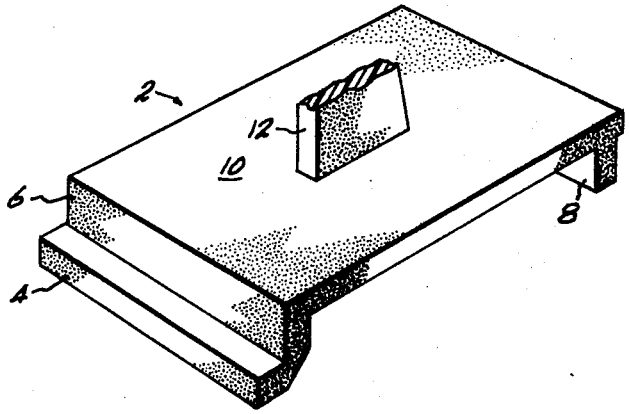
FIG. 2 is a perspective view of the invention.

The numeral 2 indicates the mounting fixture, comprised of a base plate 10 upon which the mounting arm 12 is fixedly secured. The mounting arm will vary for the intended use such as merchandise display, tool holder, shelving, etc. Formed integrally with the base plate 10 at its uppermost free end is a suspension member 6, the plane of which is disposed at right angle to the plane of the base member. Formed integrally with the suspension member 6 is a restraining member 4, which is disposed in a plane at right angles to the plane of the suspension member 6, said restraining member 4, lying in a plane parallel to the plane of the base member 10.

The lower portion of the restraining member 4, is bevelled at a 45° angle relative to the plane of the suspension member 6. This bevelled configuration permits the downward rotation, hereafter described, of the bracket. Formed integrally with the base plate 10 at the lowermost ends thereof and projecting outwardly therefrom at a plane at right angles to the said base plate 10 is a guide plate 8.

Referring now to the panelboard, of the type with which the bracket is used, a panel board base 16, is shown upon which, are secured particle board members 18 in equidistance spaced-apart relationship. Veneer 20 is then mounted on said particle boards in parallel relationship with the panel board base 16. Thus, it is seen that the panel board is of a sandwich-type construction. A router is normally used to cut grooves at regularly spaced intervals upon the face of the veneer. The grooves extend laterally and are disposed at the midpoint between adjacent rows of particle board 18.

An important feature of this panel board construction is that the portion of the grooves which extend beyond the veneer have recessed side walls. The recessed areas, or undercuts, are defined by the adjacent edges of the particle boards 18.

The grasping potential of the said undercut is harnessed by the present invention as follows: The user of the bracket, to install the same, manipulates the invention at its base plate 10, and inserts restraining member 4 into a panel board groove of desired location. To achieve penetration by the restraining member into the groove, it is necessary to align the plane of the base plate 10 normal to the plane of the panel board.

Entry of the restraining member 4 into the recessed side wall space is then achieved by downwardly rotating the invention, until the guide member 8 penetrates a downwardly spaced similar groove of the panel board. The inner surface of the base plate 10 will now be in uniform contact with the outer surface of the veneer board 20. The restraining member will snugly underlie the veneer 20.

Thus, the application of an external force to the bracket 2, in a direction normal to the plane of the panel board, will not effect the disengagement of the bracket 2 from the panel board 14.

It will also be seen that the suspension member 6 retains the invention at its desired location on the panel board, notwithstanding the application of gravitational or other external upward or downward forces.

In this manner, the bracket is in sliding engagement relationship with the panel board. The user of the bracket is thus provided with a mounting fixture, which is simple to install, relocate, economical to purchase, and which further possesses high aesthetic value.

Although a particular embodiment of the invention has been shown and described in full here, there is no intention to thereby limit the invention to the details of such embodiment. On the contrary, the intention is to cover all modifications, alternatives, embodiments, usages and equivalents of the subject invention as fall within the spirit and scope of the invention, specification and the appended claims.

What is claimed is:

1. A panelboard structure and mounting member combination, comprising, an upstanding back plate, a plurality of elongated, horizontally aligned spacing members in equi-distance relationship fixedly secured to said back plate, a front plate having a plurality of elongated, horizontally aligned grooves disposed therethrough in equidistance relationship, said grooves thereby defining a plurality of elongate, horizontally aligned front plate portions, each said groove disposed on said front plate substantially intermediate of said spacing members, said grooves having a width less than the spacing between said spacing members, a mounting member configured and dimensioned to be received in sliding engagement against an associated one of said front plate portions, said mounting member having a body portion having an outer base rectangular flat member for positioning against one of said front plate portions, one guide member extending perpendicularly from said body portion as one of a pair of opposed locking jaws secured to one end of said rectangular member, an opposite locking jaw member terminating in an offset locking piece, said locking piece extending perpendicularly from said opposite locking jaw member so that it is disposed rearwardly of said front wall portion when said mounting fixture is in position, said outer base rectangular flat member having a breadth substantially greater than the width of said grooves so that wobble of the rectangular member against the front plate portion is made minimal, whereby positioning the mounting fixture on said panelboard provides a laterally movable, non-wobbling sliding face across said front plate portion.

2. In the combination of claim 1, said mounting member comprising a first pair of planar members in spaced apart parallel relationship, the lower terminus of the first or restraining member and the upper terminus of the second or rectangular outer base member lying on a plane normal to each of said members, said spaced apart relationship defined by the length of the uppermost one or suspension member of a pair of opposing planar members, said suspension member in coaxial alignment with said normal plane, said opposing planar member or guide member secured to said rectangular base member at its lowermost end and projecting therefrom in a direction common with said suspension member.

3. The mounting member of claim 1, a beveled surface formed on the outer juncture of the said offset locking piece and said opposite locking jaw member, so that the mounting member can easily be inserted into the said panelboard.

4. In the mounting member of claim 2, a beveled surface disposed on said mounting member at the outer juncture of said restraining member and said suspension member, said beveled surface defining three sides of a regular octagon when viewed, in succession, when said rectangular base member is perpendicular to the panelboard, disposed at a 45° angle relative thereto, and parallel thereto in abutting relationship therewith.

* * * * *